US006220641B1

(12) United States Patent
Muniak

(10) Patent No.: US 6,220,641 B1
(45) Date of Patent: Apr. 24, 2001

(54) CRADLE AND PRESSURE GRIPPERS

(75) Inventor: John E. Muniak, New York, NY (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 0 days.

(21) Appl. No.: 09/616,690

(22) Filed: Jul. 14, 2000

(51) Int. Cl.[7] ..... B66C 1/22
(52) U.S. Cl. ..... 294/104; 294/116
(58) Field of Search ..... 294/50.9, 81.61, 294/82.31, 101, 103.1, 104, 116; 414/740; 901/39

(56) References Cited

U.S. PATENT DOCUMENTS 211,357 * 1/1879 Turner ..... 294/50.9
3,167,343 * 1/1965 Renfroe ..... 294/104
4,017,114 * 4/1977 LaBounty ..... 414/740
4,844,525 * 7/1989 Tarlow et al. ..... 294/104

* cited by examiner

*Primary Examiner*—Dean J. Kramer
(74) *Attorney, Agent, or Firm*—Connie Berg; Mark P. Dvorscak; Paul A. Gottlieb

(57) ABSTRACT

A gripper that is designed to incorporate the functions of gripping, supporting and pressure tongs into one device. The gripper has two opposing finger sections with interlocking fingers that incline and taper to form a wedge. The interlocking fingers are vertically off-set so that the opposing finger sections may close together allowing the inclined, tapered tips of the fingers to extend beyond the plane defined by the opposing finger section's engagement surface. The range of motion defined by the interlocking relationship of the finger sections allows the gripper to grab, lift and support objects of varying size and shape. The gripper has one stationary and one moveable finger section. Power is provided to the moveable finger section by an actuating device enabling the gripper to close around an object to be lifted. A lifting bail is attached to the gripper and is supported by a crane that provides vertical lift.

9 Claims, 3 Drawing Sheets

CRADLE AND PRESSURE GRIPPERS

U.S. GOVERNMENT RIGHTS

The United States Government has rights in this invention pursuant to Contract No. DE-AC07-81NE44139 between the U.S. Department of Energy and West Valley Nuclear Services Company.

BACKGROUND OF THE INVENTION

This apparatus is an improvement upon lifting devices such as supporting, gripping and pressure tongs used in manufacturing, demolition and material handling. Generally, lifting devices of these types are designed for a particular function or designed to lift a particular size and shape. The gripper described here is designed to incorporate the function of gripping, supporting, and pressure tongs in one device and may lift and support objects of varying size and shape. Shapes that may be lifted by the grippers include bars, pipes, tubes, T-shapes, angles, I-beams, and plates.

Supporting tongs are known and used to support objects of a particular configuration. The objects lifted and supported by supporting tongs are required to have clearance at the base of the object to allow space for the feet of the tong or gripper to contact the bottom of the object. Supporting tongs have opposing arms that are not intended to close completely together because they are designed to lift objects of a known and constant size. The gripper described here uses fingers with inclined tips that taper and act as a wedge to facilitate lifting objects directly off the floor and into the center of the device. The gripper is designed to allow complete closure of the opposing finger sections and may slightly over close allowing flexibility to lift variously sized and shaped objects. The wedge shape and inclined fingers allow the gripper to pick up objects that do not have the clearance required for use of supporting tongs.

Pressure tongs grip the vertical sides of an object, such as boxes, ingots or other right-sided objects, and apply friction to allow lifting of the object. Once objects have been lifted by the fingers of the gripper described here and the object is in or near the center of the gripper, a moveable arm squeezes the vertical sides together applying the friction required to lift the object similar to the only function of pressure tongs.

Gripping tongs, used to lift round or cylindrical objects, grip the object around the circumference with the tongs extending below the center of the object with the tongs generally in continuous contact with the rounded surface of the object. Like supporting tongs, gripping tongs have opposing arms that are not intended to close completely together. In the case of gripping tongs, they are designed to lift objects of a size range varying by about 25% and the tongs will extend just below the center of the of the object and are not designed to completely envelop the cylindrical or round object. If round or cylindrical items are to be lifted, the gripper described here supports the item below the center of the item in cradle-like hold. The gripper described here may not continuously contact the surface of round or cylindrical items, but will completely envelop the object.

The gripper provides an attachment point for a crane hook and is used for lifting, grasping, and/or supporting various structures and structural shapes in random positions. The gripping tool has two opposing finger sections. One finger section is stationary and has four individual fingers, the other finger section is moveable and has three individual fingers. There is space between the fingers of each section to allow the opposing sections to interlock. The opposing finger sections may close together allowing the inclined, tapered tips to extend beyond the plane defined by the opposing finger section's engagement surface. Thus, the interlocking fingers enable the gripper to lift and support objects of varying sizes. The interlocking fingers are more likely to bend, rather that crush or shear the lifted object if the gripper is closed too tightly. The ability to bend rather than crush or shear the object being lifted serves to decrease the amount of material that may become permanently damaged, especially thin wall tubing, if the gripper is inadvertently over-closed. Materials that become bent are more easily returned to their intended shape as compared to materials that become crushed or sheared.

Gripping tools currently known in the art to have interlocking or inter-fitting components do not allow the opposing components to close beyond the boundary defined by the opposing section because one jaw will confront the engagement surface of the opposing jaw. Examples of these types of tools are in U.S. Pat. Nos. 4,199,972 and 4,283,933 issued to Weiner.

Gripping tools currently known to have one moveable and one stationary arm are used to open and close tightly sealed containers. These tools do not have lifting bails or interlocking fingers that can extend beyond the engagement surface of the opposing arm. An example is in U.S. Pat. No. 3,862,776 issued to Sims and Borello.

The gripper may provide significant cost savings for manufacturing, demolition and material handling operations because this one device can lift and support objects of varying size and shape and thereby may eliminate the need to design supporting, gripping or pressure tongs to perform each particular function. Additional cost savings may result from the gripper's tendency to bend rather than crush or shear objects if the gripper is over-closed around the object.

OBJECTS OF THE INVENTION

The primary object of this invention is to incorporate the functions of supporting, gripping and pressure tongs into a single device.

Another object of this invention is to provide a lifting device that is capable of lifting, supporting and gripping objects of varying size and shape.

Another object of this invention is to provide lifting, supporting and gripping without permanent damage to the items being lifted, supported or gripped.

SUMMARY OF THE INVENTION

A gripper designed to incorporate the functions of gripping, supporting and pressure tongs into one device. The gripper is capable of lifting and supporting objects of varying size and shape. This one device can lift and support bars, pipes, tubes, T-shapes, angles, I-beams and plates.

The gripper uses two opposing finger sections with interlocking fingers that incline and taper to form a wedge. Power is provided to a moveable finger section by an actuating device to close the finger sections around an object to be lifted. A lifting bail on the gripper may be attached to a crane to provide for vertical lifting.

The interlocking fingers allow the flexibility required to lift and support objects of varying size and shape and will bend, rather than crush or shear, the object if the gripper is inadvertently over-closed around the object to be lifted.

BRIEF DESCRIPTION OF THE DRAWINGS

FIG. 1 *b* is a partial side elevation of the gripper in an open position.

DETAILED DESCRIPTION OF THE PREFERRED EMBODIMENT

Figure 1:
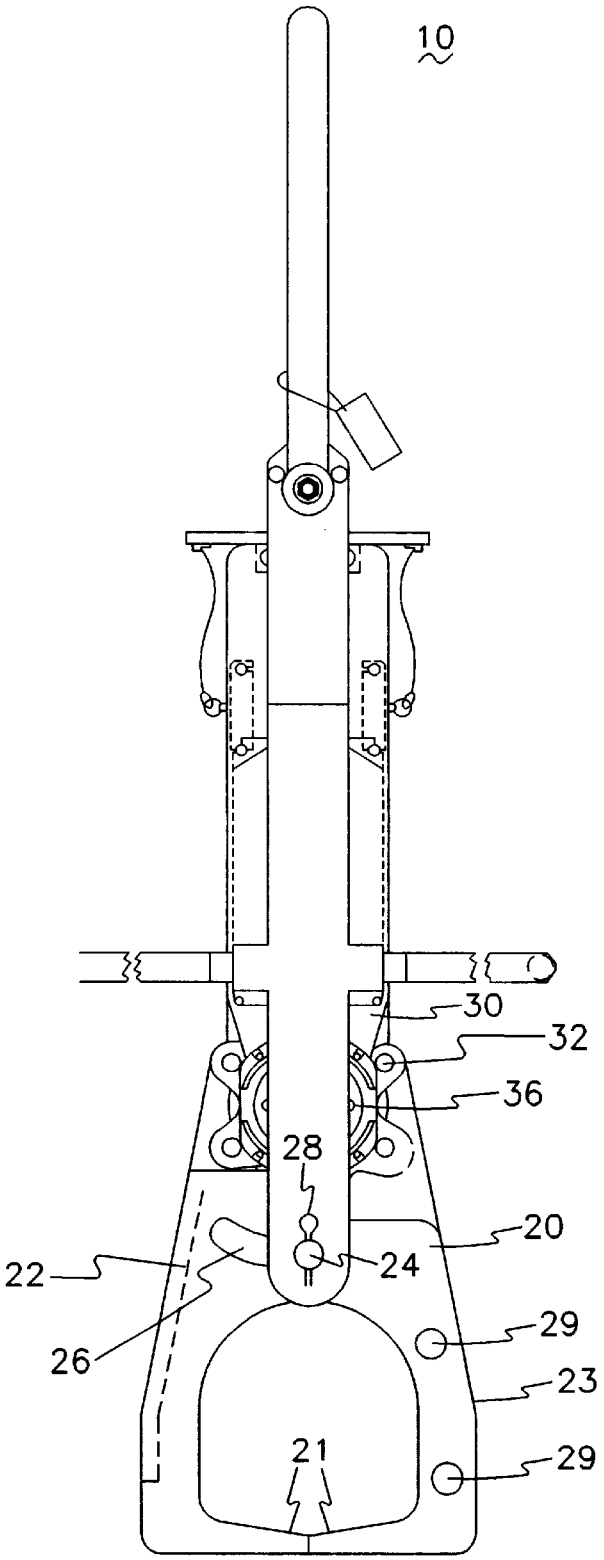
FIG. 1 is a side elevation the invention.

FIGS. 1, 1*a*, 1*b*, and 2 depict the preferred embodiment of the gripper 10. A stationary finger section 20 has four individual fingers 23. Each finger 23 is 10.5 inches long and has a horizontal tip 21 5.5 inches long that tapers at a 6° incline to form a wedge. The outside dimensions of the stationary finger section are 16.5 inches long by 6.63 inches deep by 6.0 inches wide.

The moveable finger section 22 has three individual fingers, the outside fingers 25 of the moveable section 22 are both 0.63 inches wide, the central finger 27 of the moveable finger section 22 is 0.75 inches wide. Each of the three fingers 25 and 27 are 12.06 inches in length. The outside dimensions of the moveable finger section are 16.5 inches long by 9.0 inches deep by 4 inches wide. The horizontal tip 21 portion of the fingers 23 and 25, like the tips 21 of the stationary section, is 5.5 inches long that tapers at a 6° incline to form a wedge.

The vertical component of the fingers 23 on the stationary finger section 20 are offset relative to the fingers 25 and 27 of the opposing moveable finger section 22 to allow the fingers 23 of the stationary finger section 20 to interlock with the fingers 25 and 27 of the moveable finger section 22 when the finger sections 20 and 22 move toward each other.

Two support bars 29 are attached to each finger 23 of the stationary finger section 20 and serve to maintain constant inter-spacing between the fingers 23 of the stationary finger section 20. The support bars 29 add rigidity to the stationary finger section 20 and prevent the fingers 23 from becoming mal-aligned and inhibiting smooth operation of the gripper 10.

Figure 1A:
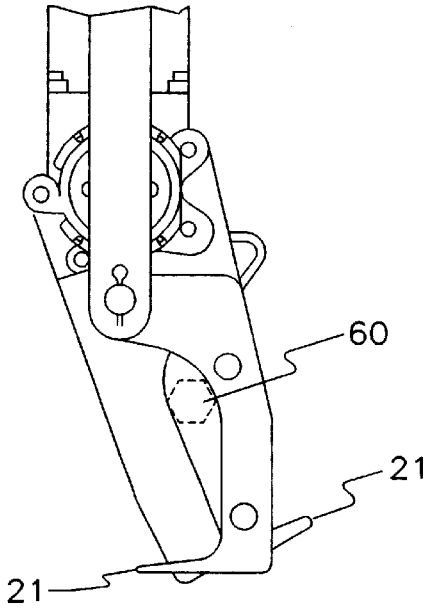
FIG. 1*a* is a partial side elevation of the gripper in a closed position.
Figure 1B:
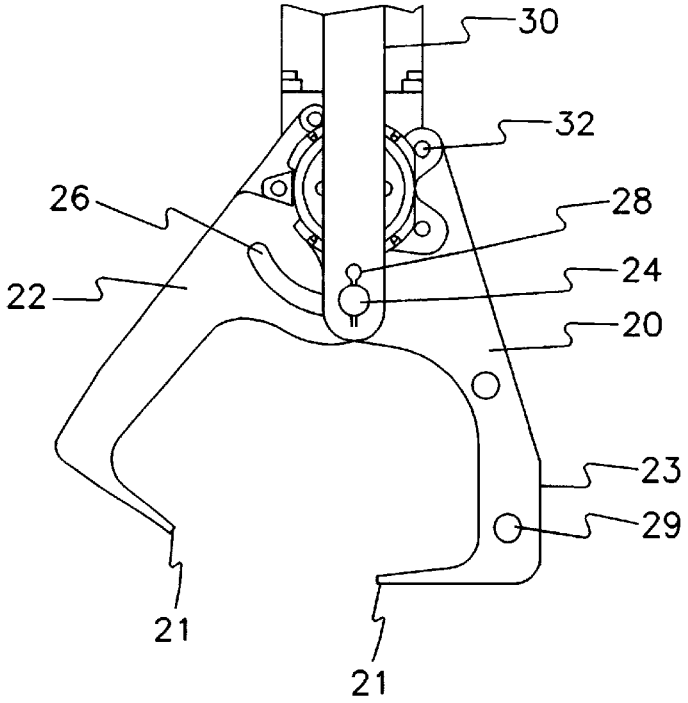
Figure 2:
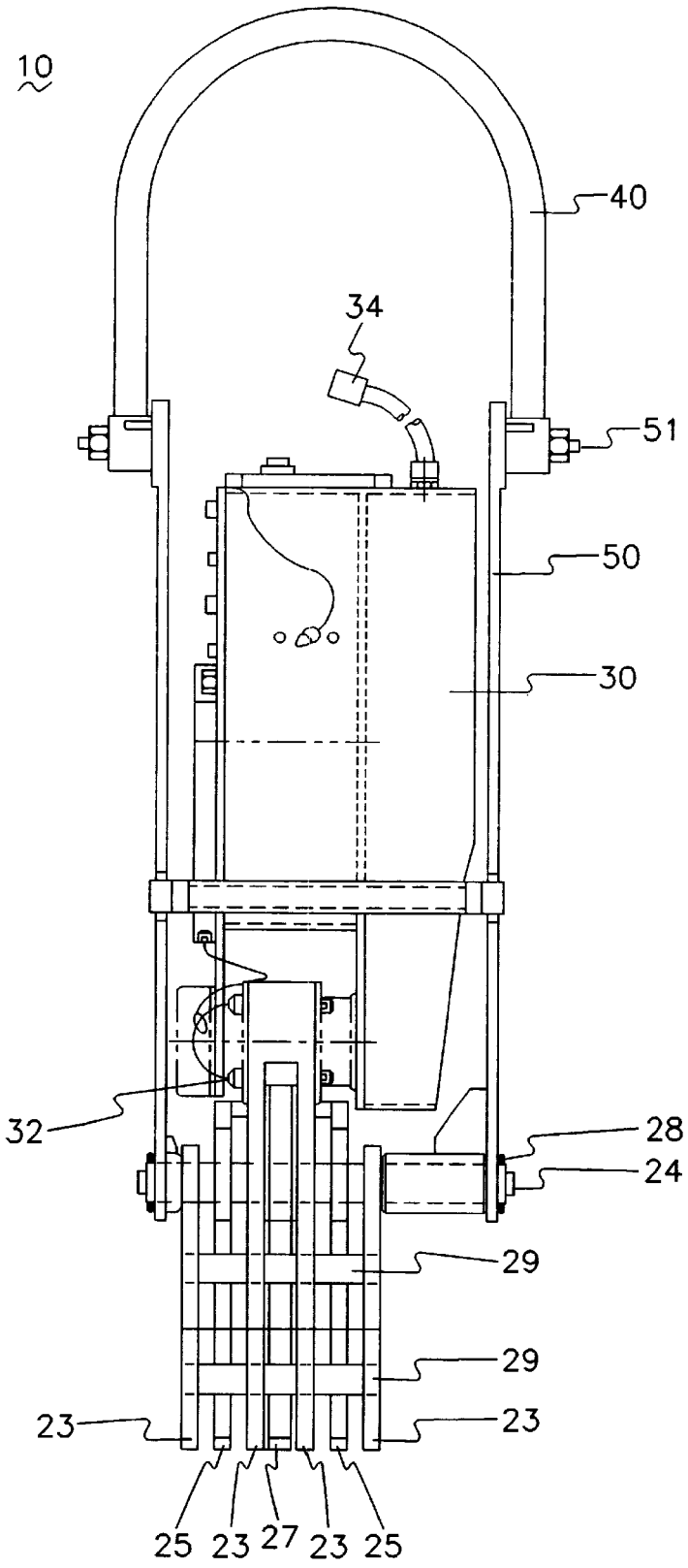
FIG. 2 is a front elevation.

The stationary finger section 20 has a clearance hole through which a pivot pin 24 is placed. The moveable finger section 22 has a slot 26 that allows the moveable finger section 22 to move relative to the pivot pin 24. A range of motion of the moveable finger section 22 relative to the stationary finger section 20 is defined by a relationship between the pivot pin 24 and the slot 26 in the moveable finger section 22. The range of motion of the gripper 10 is such that the moveable finger section 22 passes between the fingers 23 of the stationary finger section 20 to close. As depicted in FIG. 1*a*, the opposing finger sections 20 and 22 may close together allowing the inclined, tapered tips to extend beyond the plane defined by the opposing finger section's engagement surface. The engagement surface is defined as the surface of the fingers 23, 25, and 27 that contacts the workpiece 60. The inclined, tapered fingers 23, 25 and 27, combined with the interlocking and over-extending finger sections 20 and 22 allow the gripper 10 to grab, support and lift work pieces 60 of varying size and shape.

An actuating device 30 is powered by an alternating current power supply (not shown) via a power cord 34. The actuating device 30 used in the preferred embodiment is a modified Curtis-Wright P-16 Power Hawk Rescue Tool. The actuating device 30 is mounted on a support frame 50 and provides power to the moveable finger section 22 to rotate in a range of motion allowed by the pivot pin 24 and slot 26 to close around a workpiece 60. The actuating device 30 is coupled to said finger sections 20 and 22 by two sets of two quick release pins 32. One set of quick release pins 32 on either side of the actuating device 30. The moveable finger section 22 engages a rotational element 36 of the actuating device 30, such as a gear, to provide rotation to the moveable finger section 22 in the range of motion allowed by the pivot pin 24. The stationary finger section 20 is held in place, and rendered immoveable, by the quick release pins 32 that secure the finger sections 20 and 22 to the actuating device 30. If the quick release pins 32 are removed from the gripper 10 the finger sections 20 and 22 will remain secured to the support frame 50 by the pivot pin 24.

A support frame 50 is attached to the pivot pin 24 exterior to the stationary finger section 20 and held laterally in place by cotter pins 28 through small holes in the both ends of the pivot pin 24. A lifting bail 40 is attached by bolts 51 to the opposite end of the support frame 50 at the pivot pin 24. The lifting bail 40 provides a point of attachment for a crane hook (not shown). The crane (not shown) provides lift for the entire gripper 10. The gripper 10 weighs about 100 pounds and has a safe working load of about 2000 pounds.

What is claimed is:

1. A gripper, comprising:

a support frame having a first and a second end;

a stationary finger section comprised of a plurality of stationary fingers and attached to said second end of the support frame, each finger positioned to provide an interfinger spacing between adjacent fingers;

a moveable finger section having a plurality of moveable fingers spaced to allow movement of said moveable fingers through the inter-finger spacing of said stationary finger section, each moveable finger having a slot similarly positioned on each moveable finger such that each of said slots are aligned and extend through the entire moveable finger section;

a pivot pin which transgresses a hole through said stationary finger section and passes through said slots of the moveable fingers where a range of motion of the moveable finger section is defined by a relationship between said pivot pin and said slots, the ends of said pin pass through a pair of holes in said second end of said support frame and have a means for securing said pin to prevent lateral movement;

an actuating device coupled to said moveable finger section to provide power to the moveable finger section to rotate the moveable finger section; and a lifting bail attached to said first end of the support frame providing a point of attachment to lift and lower the gripper.

2. The gripper of claim 1 wherein said relationship between the pivot pin and the slots allows over-closure of said finger sections such that a tip of said fingers may extend beyond an engagement surface of an opposing finger section; said engagement surface is a surface of said fingers that contacts a workpiece.

3. The gripper of claim 1 further comprising a support bar attached to each of said plurality of fingers on said stationary finger section to join and rigidly fix said interfinger spacing.

4. The gripper of claim 1 where said gripper is fabricated of steel or stainless steel.

5. The gripper of claim 1 wherein said stationary finger section has outside dimensions of 16.5 inches by 6.63 inches by 6.0 inches, and has four individual fingers each being 0.5 inches wide and 10.5 inches long and having a horizontal tip of 5.5 inches and tapering to a wedge on a 6° incline.

6. The gripper of claim 5 wherein said moveable finger section has outside dimensions of 16.5 inches by 9.0 inches by 4.0 inches, and has three individual fingers with widths of between 0.63 and 0.75 inches and 12.06 inches long, each finger having a horizontal tip of 5.5 inches and tapering to a wedge at a 6° incline.

7. The gripper of claim 1 wherein said range of motion between said fingers sections is such that the grippers can cradle a 6-inch pipe with outer diameter of 6.625 inches.

8. The gripper of claim 1 wherein said range of motion between said finger sections is such that the grippers can grab tubing of about 0.25 inches.

9. The gripper of claim 1 wherein its safe working load is rated up to 2,000 pounds.

* * * * *